US009835308B2

(12) United States Patent
Di Giovine

(10) Patent No.: US 9,835,308 B2
(45) Date of Patent: Dec. 5, 2017

(54) LIGHT INDICATOR

(71) Applicant: Vincenzo Di Giovine, Lecco (IT)

(72) Inventor: Vincenzo Di Giovine, Lecco (IT)

(73) Assignee: COMBUSTION AND ENERGY S.R.L., Oggiono (LC) (IT)

( * ) Notice: Subject to any disclaimer, the term of this patent is extended or adjusted under 35 U.S.C. 154(b) by 386 days.

(21) Appl. No.: 14/506,709

(22) Filed: Oct. 6, 2014

(65) Prior Publication Data

US 2015/0098221 A1 Apr. 9, 2015

(30) Foreign Application Priority Data

Oct. 8, 2013 (IT) ..... 20130054 U

(51) Int. Cl.

| | |
|---|---|
| ***F21S 8/00*** | (2006.01) |
| ***F21V 5/04*** | (2006.01) |
| ***F21V 17/06*** | (2006.01) |
| ***F21V 17/16*** | (2006.01) |
| *F21W 111/00* | (2006.01) |
| *F21Y 103/10* | (2016.01) |
| *F21Y 115/10* | (2016.01) |

(52) U.S. Cl.

CPC ..... *F21V 5/04* (2013.01); *F21V 17/06* (2013.01); *F21V 17/164* (2013.01); *F21W 2111/00* (2013.01); *F21Y 2103/10* (2016.08); *F21Y 2115/10* (2016.08)

(58) Field of Classification Search

CPC ..... F21V 5/04; F21V 17/08; F21V 17/164

See application file for complete search history.

(56) References Cited

U.S. PATENT DOCUMENTS

| | | | | |
|---|---|---|---|---|
| 6,580,228 | B1 * | 6/2003 | Chen | F21K 9/90 257/E25.02 |
| 7,021,809 | B2 * | 4/2006 | Iwasa | F21S 4/26 362/23.01 |
| 7,810,968 | B1 * | 10/2010 | Walker | F21S 8/08 362/218 |
| 8,360,608 | B2 * | 1/2013 | Wildner | G09F 9/301 362/237 |
| 9,239,151 | B2 * | 1/2016 | Mikami | F21V 29/74 |
| 2005/0174782 | A1 * | 8/2005 | Chapman | F21L 4/027 362/319 |
| 2008/0043466 | A1 * | 2/2008 | Chakmakjian | F21V 5/007 362/237 |

(Continued)

FOREIGN PATENT DOCUMENTS

| | | |
|---|---|---|
| EP | 2565519 | 3/2013 |

*Primary Examiner* — Anabel Ton

(74) *Attorney, Agent, or Firm* — Mark M. Friedman

(57) ABSTRACT

Light indicator which comprises a support body to which multiple rows of LEDs and multiple lenses are fixed, each of which positioned in front of the corresponding row of LEDs, and provided with a rear surface directed towards the LEDs, and with a front surface directed in the sense opposite the aforesaid rear surface. In addition, the light indicator comprises multiple coupling bodies, each of which extended between two ends thereof, of which a rear end is engaged with the support body, and a front end is provided with a first bent portion engaged in abutment against the front surface of the corresponding lens in order to retain the latter integral with the support body itself.

16 Claims, 8 Drawing Sheets

(56) References Cited

U.S. PATENT DOCUMENTS

| | | | | |
|---|---|---|---|---|
| 2011/0089830 | A1* | 4/2011 | Pickard | F21K 9/135 315/32 |
| 2014/0301085 | A1* | 10/2014 | Hwang | F21V 17/06 362/308 |

* cited by examiner

LIGHT INDICATOR

FIELD OF APPLICATION

The present finding refers to a light indicator, according to the preamble of the independent claim.

The present light indicator is inserted in the industrial field of production of light indicators and illumination apparatuses provided with light sources of LED type, and it is intended to be advantageously employed for indicating to aircraft the presence of high structures, such as smokestacks, towers, skyscrapers, bridges, power line pylons, etc.

In particular, the aforesaid light indicator is advantageously employed for signaling the presence of towers or other high buildings, especially those situated in urban areas.

STATE OF THE ART

It is known to use light indicators mounted for example on towers, on smokestacks or on industrial plant and factory buildings, or on bridges, pylons etc., in order to indicate the presence of aerial obstacles to vehicles such as airplanes and helicopters.

In particular, increasingly widespread on the market are light indicators provided with light sources of LED type, since the latter demonstrate greater luminous efficiency than most of the light sources of conventional type (such as incandescent lamps, fluorescent lamps, discharge lamps).

More in detail, one example of light indicator of known type comprises a metal tubular body, which is provided with an external surface on which a plurality of LEDs are mounted; each LED is oriented with its light emission axis orthogonal to the external surface of the tubular body.

In particular, each LED is formed by a diode which is constituted by semiconductor material and is enclosed in an epoxy or plastic covering, covered with a surface layer of phosphor.

In addition, the light indicator comprises a plurality of lenses, each of which fixed on the external surface of the tubular body in front of the LED, intercepting the light emission axis of the latter, and adapted to concentrate the light emitted by such LED into light beams mainly oriented along a horizontal optical axis.

More in detail, each lens comprises a substantially hemispherical body of transparent material, provided with an internal cavity in which the corresponding LED is housed, and with a base edge fixed to the external surface of the tubular body around the LED itself.

In particular, each lens is fixed to the external surface of the tubular body of the light indicator by means of an adhesive material layer arranged between the base edge of the lens and the external surface of the tubular body.

A first drawback of the above-described indicator of known type is due to the fact that the adhesive material, employed for attaching each lens to the tubular body of the indicator, easily comes into contact with the LED arranged inside the lens itself, coming to damage the phosphor layer arranged on the LED covering and therefore limiting the luminous efficiency of the LED itself.

A further drawback is due to the fact that the adhesive material can be easily deteriorated, for example due to the heat generated by the LEDs during the operation thereof, with a consequent separation of the lenses from the tubular body of the indicator.

Presentation of the Finding

In this situation, the main object of the present finding is therefore to overcome the drawbacks shown by the solutions of known type, by providing a light indicator capable of operating in an entirely efficient manner.

Further object of the present finding is to provide a light indicator which is structurally simple and inexpensive to make.

Further object of the present finding is to provide a light indicator which is capable of operating in an efficient manner, in particular for long time periods.

Further object of the present finding is to provide a light indicator which is capable of efficiently removing the heat generated by the LEDs.

BRIEF DESCRIPTION OF THE DRAWINGS

The technical characteristics of the invention, according to the aforesaid objects, can be clearly found in the contents of the below-reported claims and the advantages thereof are more evident in the following detailed description, made with reference to the enclosed drawings, which represent several merely exemplifying and non-limiting embodiments of the invention, in which:

DETAILED DESCRIPTION OF A PREFERRED EMBODIMENT

Figure 1:
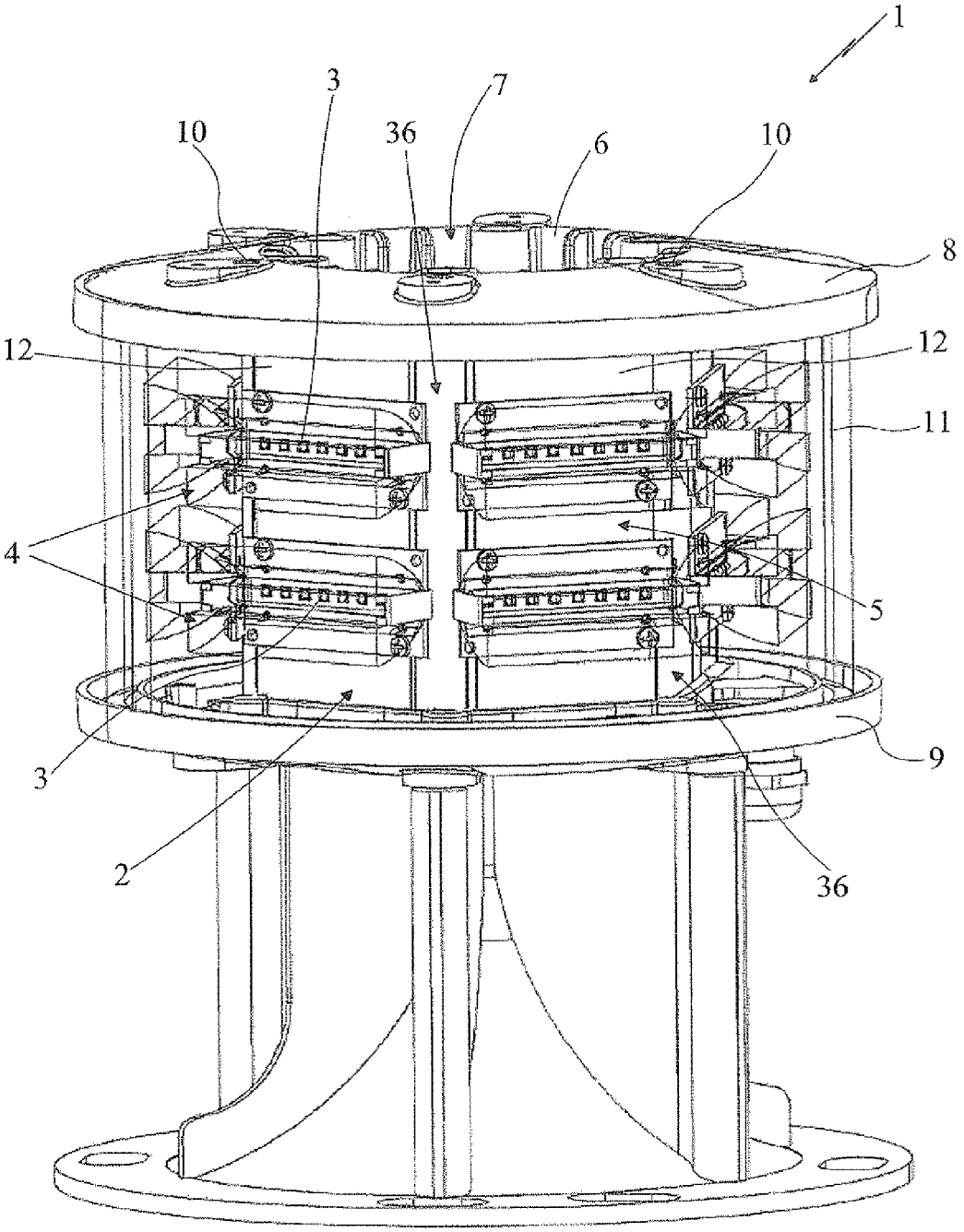
FIG. 1 shows a perspective view of the light indicator, subject of the present finding, in accordance with a first embodiment.

With reference to the set of drawings, reference number 1 indicates overall the light indicator, subject of the present finding.

The present light indicator 1 is intended to be advantageously mounted on high buildings (such as skyscrapers, towers, etc.) or on high structures (such as bridges, pylons, smokestacks etc.) in order to indicate the presence of aerial obstacles to vehicles such as airplanes and helicopters.

According to the present finding, the light indicator 1 comprises a support body 2 to which at least one LED 3 and at least one lens 4 are fixed, positioned in front of the corresponding LED 3 in order to collimate the light emitted by the latter.

In accordance with the embodiments illustrated in the enclosed figures, the support body 2 has substantially tubular form (in particular with polygonal section, e.g. hexagonal section) and is provided with an external surface 5 around which a plurality of the aforesaid LEDs 3 and a plurality of corresponding aforesaid lenses 4 are positioned.

In particular, the support body 2, preferably made of metal material (e.g. aluminum), is longitudinally extended with preferably vertical axis between an upper edge thereof and a lower edge thereof, between which the aforesaid external surface 5 is extended, and is also provided with an internal surface 6, which defines an internal channel 7 of the support body 2 itself. Preferably, in accordance with the embodiments illustrated in FIGS. 1 and 7, the light indicator 1 comprises an upper annular flange 8 and a lower annular flange 9, which are respectively fixed to the upper edge and to the lower edge of the support body 2, in particular by means of retention screws 10, and are each provided with a corresponding central opening aligned with the internal channel 7 of the support body 2 itself.

Preferably, the light indicator 1 also comprises a cylindrical sheet 11 made of light-permeable material that is placed around the external surface 5 of the support body 2 and is closed on the top and bottom part respectively by the upper 8 and lower 9 annular flange of the indicator 1 itself.

Advantageously, the external surface 5 of the support body 2 of the light indicator 1 comprises multiple flat faces 12 facing each other; on each face, one or more rows of LEDs 3 is preferably positioned. In particular, with reference to the embodiment of FIG. 3, the LEDs 3 of each row are arranged substantially aligned with each other along an alignment direction X parallel to the corresponding flat face 12 of the external surface 5 of the support body 2, and each LED is provided with its light emission axis Y orthogonal to the flat surface itself.

Figure 7:
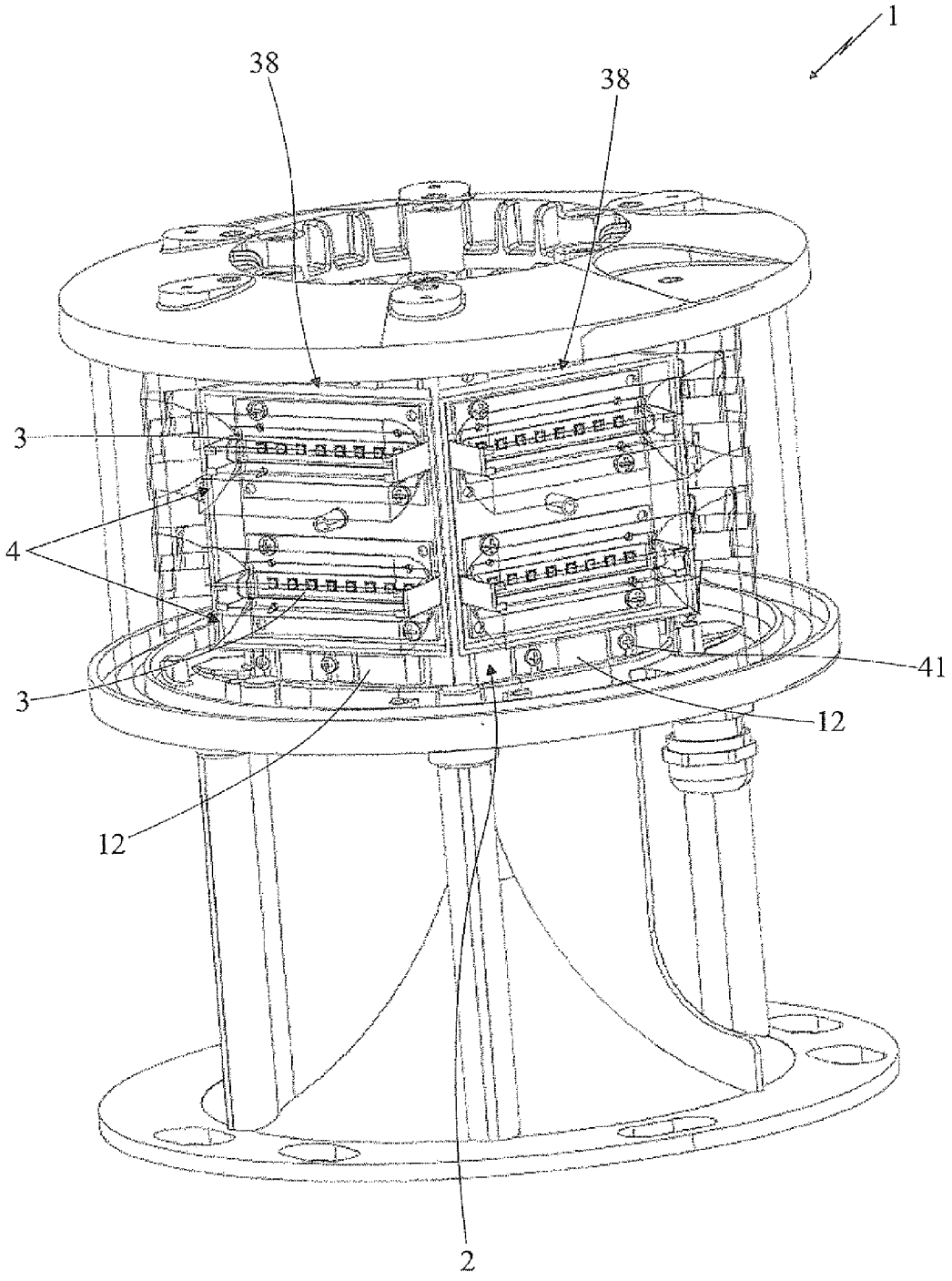
FIG. 7 shows a perspective view of the light indicator, subject of the present finding, in accordance with a third embodiment.

In accordance with the embodiment illustrated in FIGS. 1 and 7, the light indicator 1 comprises multiple rows of LEDs 3 (e.g. two) arranged on each flat face 12 of the external surface 5 of the support body 2. Of course, without departing from the protective scope of the present patent, the light indicator 1 can also comprise only one row of LEDs 3 positioned on each flat face 12, or more than two rows of LEDs 3 positioned on each flat face 12.

Preferably, each lens 4 has substantially elongated form and is positioned in front of the LEDs 3 of a corresponding aforesaid row of LEDs, to intercept the light emission axes Y of such LEDs 3 in order to collimate the light emitted by the latter.

According to the present finding, each lens 4 is provided with a rear surface 13 directed towards the corresponding row of LEDs 3 and through which preferably the lens 4 receives in inlet the light emitted by the LEDs 3 themselves. In addition, each lens 4 is provided with a front surface 14 directed in the sense opposite the rear surface 13, and through which the lens 4 advantageously emits beams of collimated light rays.

According to the idea underlying the present finding, the light indicator 1 comprises at least one coupling body 15, which is extended between two ends 16, 17 thereof, of which a rear end 16 is engaged with the support body 2 of the light indicator 1, and a front end 17 is provided with at least one first bent portion 18 engaged in abutment against the front face 14 of the corresponding lens 4 in order to retain the latter integral with the support body 2 itself.

Figure 3:
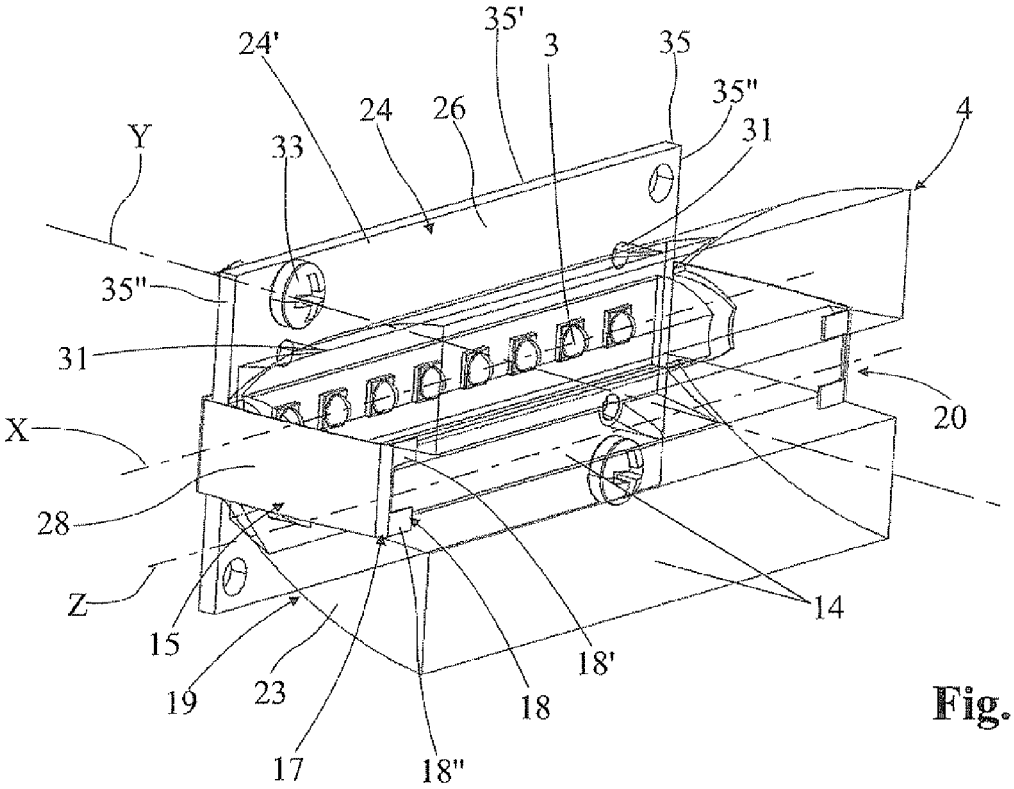
FIGS. 3 and 4 respectively show a front perspective view and a rear perspective view of a detail of the light indicator, subject of the present finding, relative to a row of LEDs with the corresponding light collimation lens associated therewith.
Figure 4:
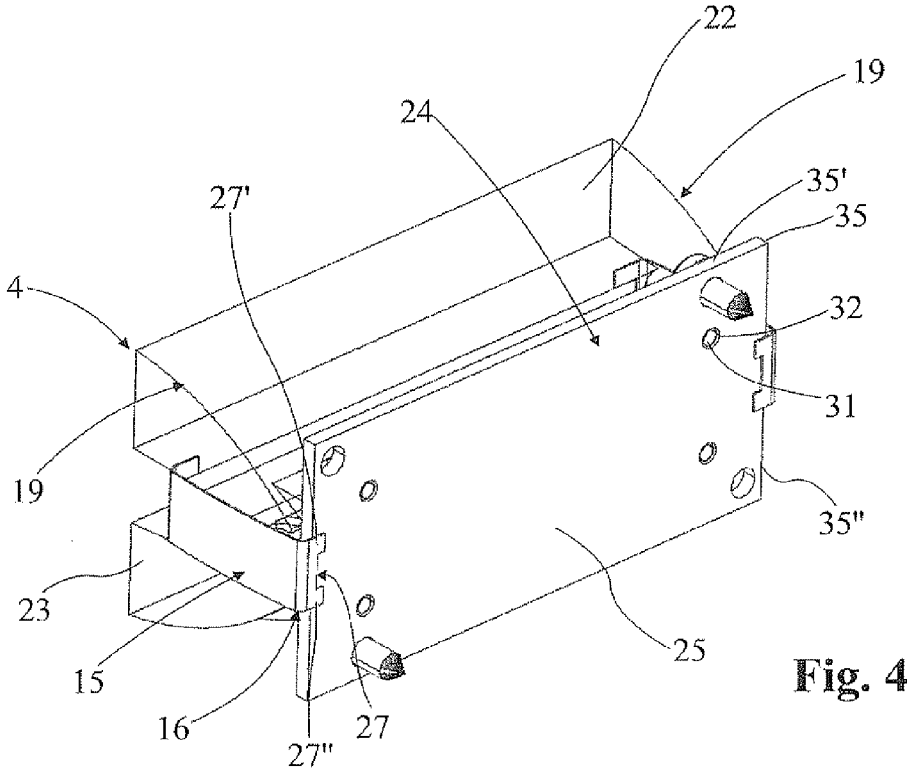

Advantageously, with reference to the embodiment illustrated in FIGS. 3 and 4, each lens 4 has elongated form and is extended between two ends 19 thereof according to an extension direction Z substantially parallel to the alignment direction X of the corresponding row of LEDs 3.

The light indicator 1 comprises at least two aforesaid coupling bodies 15, each arranged at the respective end 19 of the respective lens 4 in order to retain it integral with the support body 2.

Advantageously, each lens 4 is provided, on its front face 14, with a front groove 20 inside of which the first bent portion 18 of the coupling bodies 15 is engaged.

Preferably, with reference to the embodiment illustrated in FIGS. 3 and 4, the front groove 20 of each lens 4 is longitudinally extended according to the extension direction Z between the two ends 19 of the lens 4 itself, at which the front groove 20 terminates with two respective lateral openings in order to allow the insertion of the first bent portions 18 of the corresponding coupling bodies 15 in the front groove 20 itself.

In particular, the aforesaid front groove 20 is closed on the bottom by a curved and convex portion of the front surface 14 of the lens 4, and preferably the remaining portions of the front surface 14, arranged along two longitudinal sides of the front groove 20, have a flat form.

Preferably, the first bent portion 18 of each coupling body 15 is inserted in the front groove 20 from the corresponding end 19 of the lens 4, being anchored on the portion of the front surface 14 that delimits the bottom of the front groove 20 itself.

Advantageously, the rear surface 13 of each lens 4 is provided with a rear groove 21, which is longitudinally extended according to the extension direction Z of the lens 4 itself, and houses the corresponding row of LEDs 3 at its interior.

Preferably, each lens 4 comprises two longitudinal surfaces 22, placed to connect between the rear surface 13 and the front surface 14, and in particular with substantially curved form.

The two ends 19 of each lens 4 are closed by two respective lateral surfaces 23, preferably flat, and arranged orthogonal to the extension direction Z of the lens itself.

Advantageously, each lens 4 is made of plastic material, in particular PMMA, and is preferably obtained by means of molding.

Advantageously, the present light indicator 1 comprises at least one support plate 24 provided with a rear face 25 fixed to the support body 2, and with a front face 26, directed in the sense opposite that of the rear face 25 and on which the LEDs 3 and the corresponding lenses 4 are fixed.

The rear end 16 of each coupling body 15 is provided with at least one second bent portion 27, which is engaged in abutment against the rear face 25 of the aforesaid support plate 24. In this manner, each coupling body 15, acting on one side on the front surface 14 of the lens 4 (by means of the first bent portion 18) and on the other side on the rear face 25 of the support plate 24 (by means of the second bent portion 27) retains the corresponding lens 4 integral with the support plate 24.

Advantageously, each coupling body 15 is provided with a central portion 28, which is placed to connect between the first and the second bent portion 18, 27. Such central portion 28 is provided with an internal side 29 directed towards the lens 4, from which the bent portions 18, 27 are projectingly extended, and with an external side 30 directed in the sense opposite that of the internal side 29.

In accordance with the embodiments illustrated in the enclosed figures, the central portion 28 of each coupling body 15 is directed with its internal side 29 towards the corresponding end 19 of the lens 4 which retains the support plate 24.

The first bent portion 18 of each coupling body 15 is inserted in the front groove 20 of the corresponding lens 4, extended above the front surface 14 of the latter, starting from the edge defined by the junction of the front surface 14 with the lateral surface 23 facing the coupling body 15 itself.

In the present description, the front surface 14 of the lenses 4, on which the first bent portions 18 of the coupling bodies 15 are engaged, is intended to be any one surface of the lenses 4 opposite the rear surface 13 of the latter, in particular also a surface of the lenses 4 from which the collimated light ray beams do not exit. For example, in accordance with an embodiment not shown in the enclosed figures, each lens is provided with a peripheral flange projecting from the longitudinal surfaces of the lens and provided with a rear surface abutted against the support plate, and with a front surface against which the first bent portions of the coupling bodies are engaged in abutment.

Advantageously, each bent portion 18, 27 of each coupling body 15 delimits, with the internal side 29 of the central portion 28, an angle less than or equal to 90°, in order to allow the first and the second bent portion 18 and 27 to be respectively coupled to the lens 4 and to the support plate 24.

Preferably, each coupling body 15 is made of elastically flexible material, and is in particular obtained with a metal plate bent at the ends 16, 17, with preferably elongated form and provided with two longitudinal profiles parallel to each other.

Advantageously, each bent portion 18, 27 of each coupling body 15 comprises at least two corresponding appendages 18', 18" and 27', 27" that are parallel and spaced from each other, and extended along two longitudinal profiles of the coupling body 15 itself.

Preferably, the first and the second bent portion 18, 27 of each coupling body 15 are elastically deformed in moving away from each other, respectively from the front surface 14 of the lens 4 and from the rear face 25 of the support plate 24.

In this manner advantageously, the first and the second bent portion 18, 27 of the coupling body 15, when they are engaged with the corresponding lens 4, are each subjected to an elastic reaction force that tends to push them respectively against the front surface 14 of the lens 4 and the rear face 25 of the support plate 24, in this manner retaining the lens 4 integral with the support plate 24 itself.

In accordance with the embodiments illustrate in the enclosed figures, the light indicator 1 comprises multiple support plates 24 arranged on the corresponding flat faces 12 of the external surface 5 of the support body 2, each of which bearing, mounted on its front face 26, the corresponding row of LEDs 3 and the corresponding lens 4 associated with such row of LEDs 3.

Advantageously, each lens 4 is provided with engagement pins 31 projecting from its rear surface 13 and inserted in corresponding holes 32 made on the corresponding support plate 24 in order to position the lens 4 with its extension axis Z parallel to the alignment direction X of the corresponding row of LEDs 3.

In accordance with a first and with a second embodiment of the present finding illustrated in FIGS. 1-6, the rear face 25 of each support plate 24 is fixed to the corresponding flat face 12 of the external surface 5 of the support body 2 by means of preferably first fixing screws 33.

Preferably, each support plate 24 is obtained with an electric circuit board 24' adapted to power supply the LEDs 3 mounted thereon.

Advantageously, each electric circuit board 24' is connected, preferably by means of one or more electrical connection cables 34, to an electronic control unit (not shown) for the light indicator 1 adapted to control the operation of the LEDs 3, preferably in accordance with programmed operating modes.

The control unit is advantageously connected to a source of electrical energy (not shown) from which it receives the electric current for supplying power to the LEDs 3 of the light indicator 1.

Advantageously, each electric circuit board 24' comprises a printed circuit, in particular of metal core type, on which metal tracks (not shown) are preferably obtained that are adapted to connect the LEDs 3 mounted on the electric circuit board 24' to the electrical connection cables 34 in order to allow the power supply of the LEDs 3 themselves.

In operation, the LEDs 3 during the operation thereof transfer the heat generated thereby to the printed circuit of the corresponding electric circuit board 24', which in turn transfers such heat via conduction to the support body 2. The latter transmits the heat to the air present in the internal channel 7 of the support body 2 itself. The air thus heated generates an ascending air flow that transports via convection the heat received from the support body 2 to outside the light indicator 1.

Advantageously, each support plate 24 has a preferably polygonal form, in particular rectangular form, and is provided with a peripheral edge 35 having two longitudinal sides 35', parallel to the alignment direction X of the corresponding row of LEDs 3, and two transverse sides 35" orthogonal to the longitudinal sides 35' and placed to connect the latter.

Advantageously, the support body 2 is provided with multiple engagement cavities 36 arranged at the peripheral edge 35 of each support plate 24, at least partially extended below the rear face 25 of the support plate 24 itself. At such engagement cavities 36, the second bent portions 27 of the coupling bodies 15 are positioned, such portions abutting against the portions of the rear face 25 of the support plate 24 facing such engagement cavities 36.

Figure 2:
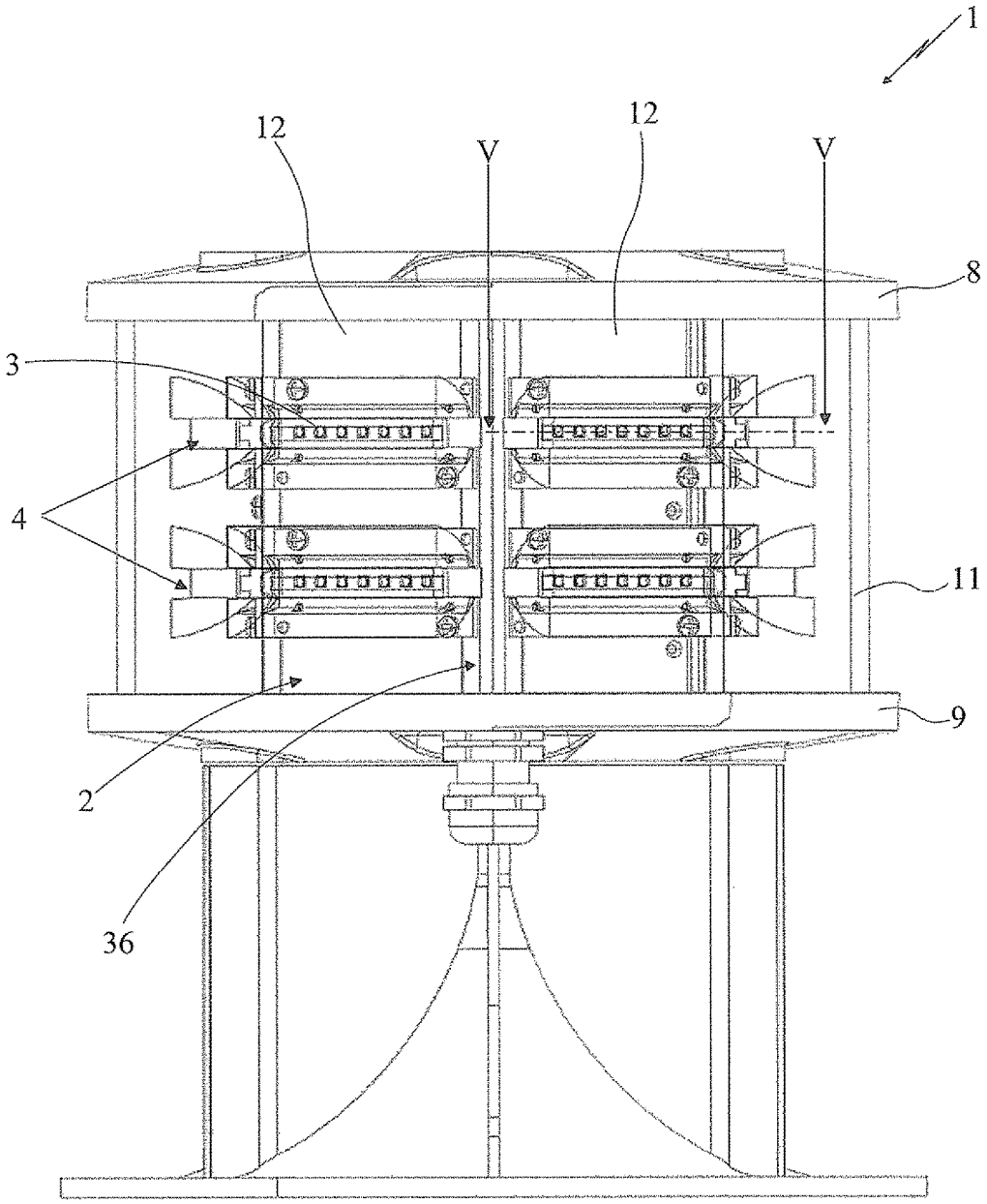
FIG. 2 shows a side view of the light indicator illustrated in FIG. 1.
Figure 5:
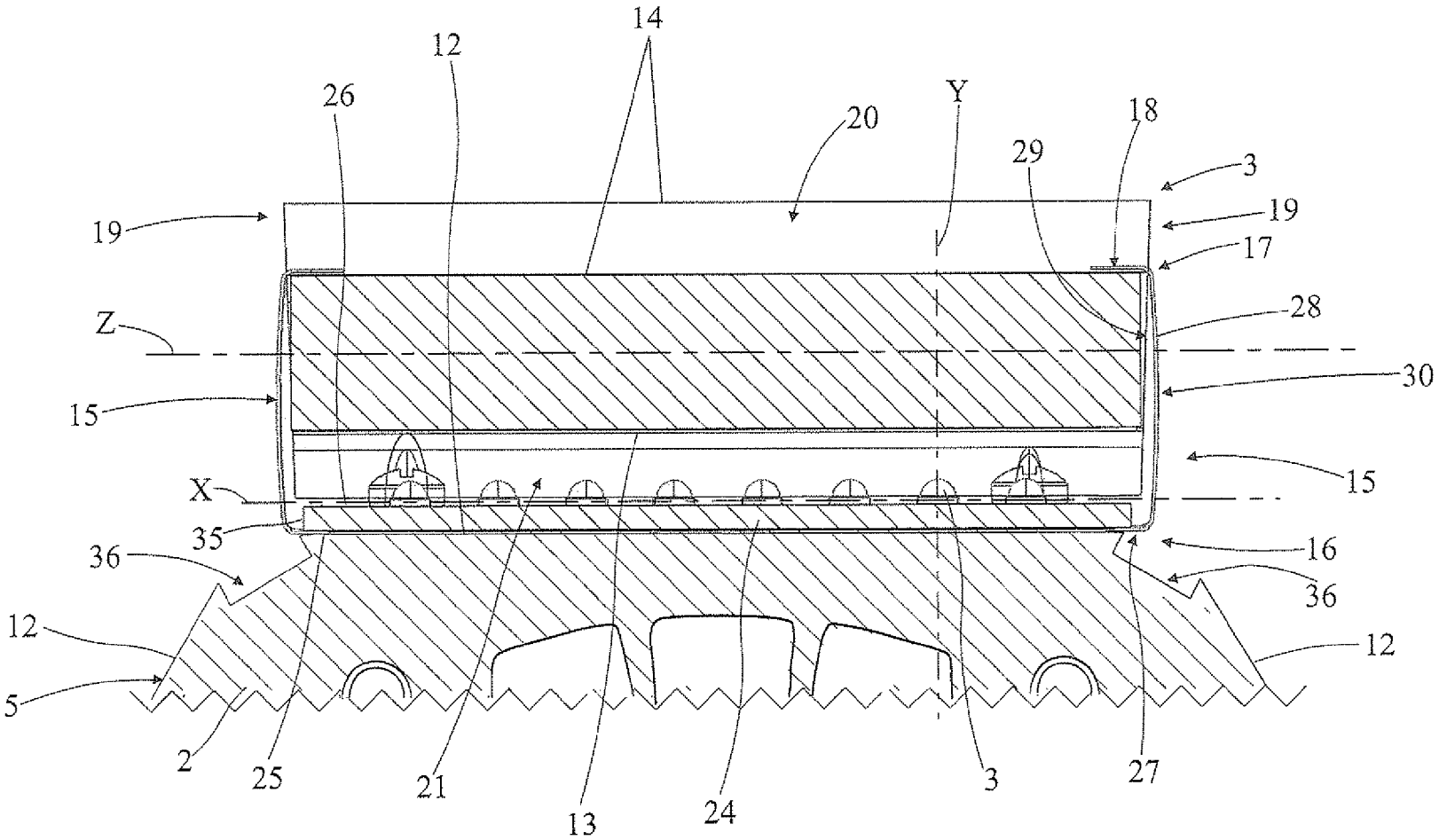
FIG. 5 shows a section view of the light indicator illustrated in FIG. 2 along the line V-V of FIG. 2 itself, with some parts removed in order to better illustrate others.

Advantageously, in accordance with the first embodiment illustrated in FIGS. 1, 2 and 5, the engagement cavities 36 are obtained on the external surface 5 of the support body 2, and are preferably obtained with longitudinal grooves extended between the upper edge and the lower edge of the support body 2 itself.

In particular, each longitudinal groove is extended parallel to the axis of the support body 2 and is positioned at the edges of the latter defined by the junction of the adjacent flat faces 12 of the external surface 5 of the support body 2 itself.

Advantageously, each aforesaid longitudinal groove houses at its interior a section of the electrical connection 34 (which connect the circuit boards 24' to the electronic control unit), in a manner such that such cables 34 are not arranged in front of the LEDs 3 and the lenses 4, blocking the emission of the light.

With reference to the first embodiment illustrated in FIG. 5, each support plate 24 projects with the transverse side 35" of its peripheral edge 35 above the corresponding engagement cavity 36, so as to leave a portion of the rear face 25 of the plate 24 itself facing the engagement cavity 36 and therefore not adjacent to the external surface 5 of the support body 2. The second bent portion 27 of the coupling bodies 15 is engaged in abutment against such portion of the rear face 25 of the support plate 24; the coupling bodies 15 preferably abut with the central portions 28 against the transverse side 35" of the peripheral edge 35 of the support plate 24.

Figure 6:
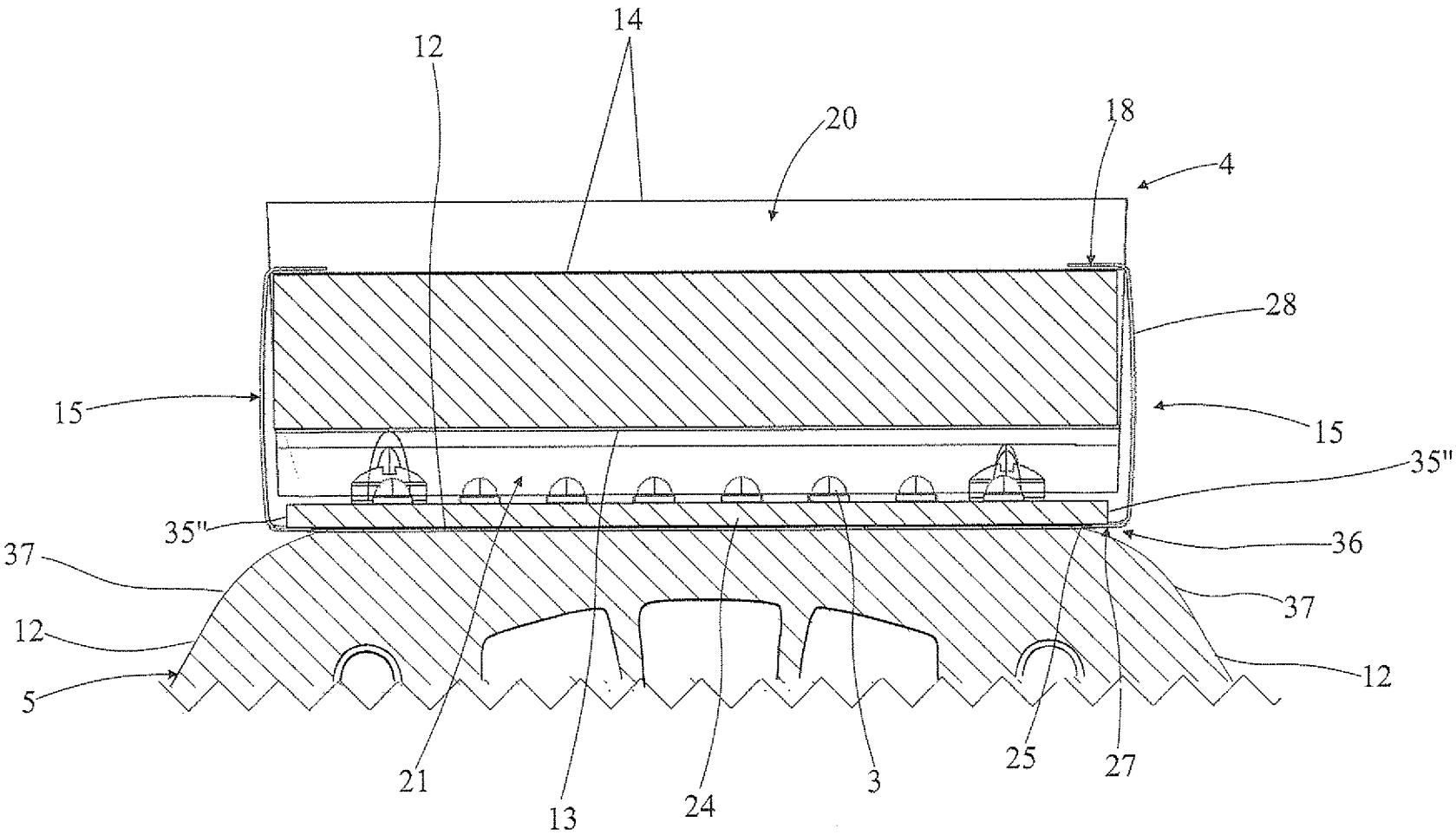
FIG. 6 shows a cross section view of the light indicator, subject of the present finding, in accordance with a second embodiment, with some parts removed in order to better illustrate others.

Advantageously, in accordance with the second embodiment of the light indicator 1 subject of the present finding, illustrated in FIG. 6, each flat face 12 of the external surface 5 of the support body 2 is connected to the flat face 12 adjacent thereto by means of a rounded longitudinal edge 37 of the external surface 5 itself; such rounded longitudinal edge 37 delimits, with the rear face 25 of each support plate 24, the engagement cavities 36 in which the second bent portions 27 of the coupling bodies 15 are inserted in order to be engaged in abutment against the rear face 25 of the support plate 24 itself.

The aforesaid engagement cavities 36 allow advantageously engaging the second bent portions 27 of the coupling bodies 15 with the rear face 25 of the support plates 24, at the same time allowing the adhesion of most of the rear face 25 of the plates 24 themselves to the corresponding flat faces 12 of the external surface 5 of the support body 2, in a manner such to facilitate the thermal transmission of the heat (produced by the LEDs 3) between the support plates 24 and the support body 2 with a consequent efficient heat removal.

The enclosed FIGS. 7-11 illustrate a third embodiment of the light indicator, subject of the present finding, which is particularly suitable for being employed in environments with high explosion risk, such as petrochemical plants, natural gas extraction plants, refineries, textile products industries, plastic materials industries, pharmaceutical industries, mines.

Preferably, in accordance with such third embodiment of the present light indicator 1, the support body 2 comprises at least one tray 38 inside of which the support plate 24 is positioned, advantageously constituted by the aforesaid electric circuit board 24' for the power supply, bearing the LEDs 3 and the corresponding lens 4 fixed thereto.

In particular, with reference to the FIG. 7, the support body 2 is provided with multiple trays 38 positioned on the flat faces 12 of the external surface 5 of the support body 2 itself, each tray containing at least one electric circuit board 24' (e.g. two) with the corresponding row of LEDs 3 and the corresponding lens 4.

Figure 9:
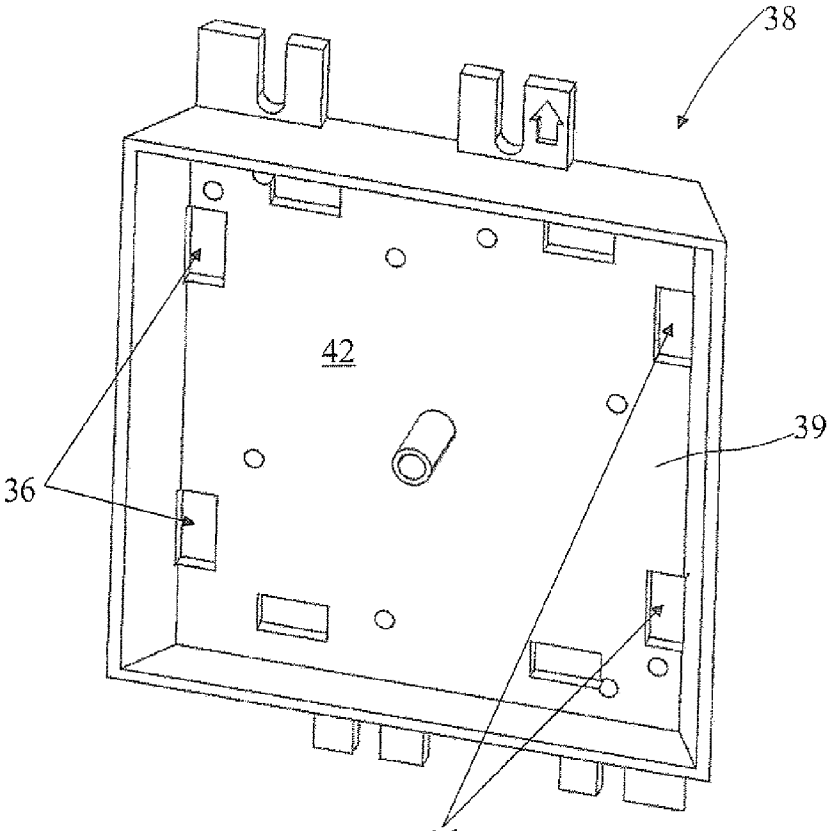
FIG. 9 shows the tray illustrated in FIG. 8, in which the LEDs and the lenses have been removed in order to better illustrate some details of the tray itself.
Figure 8:
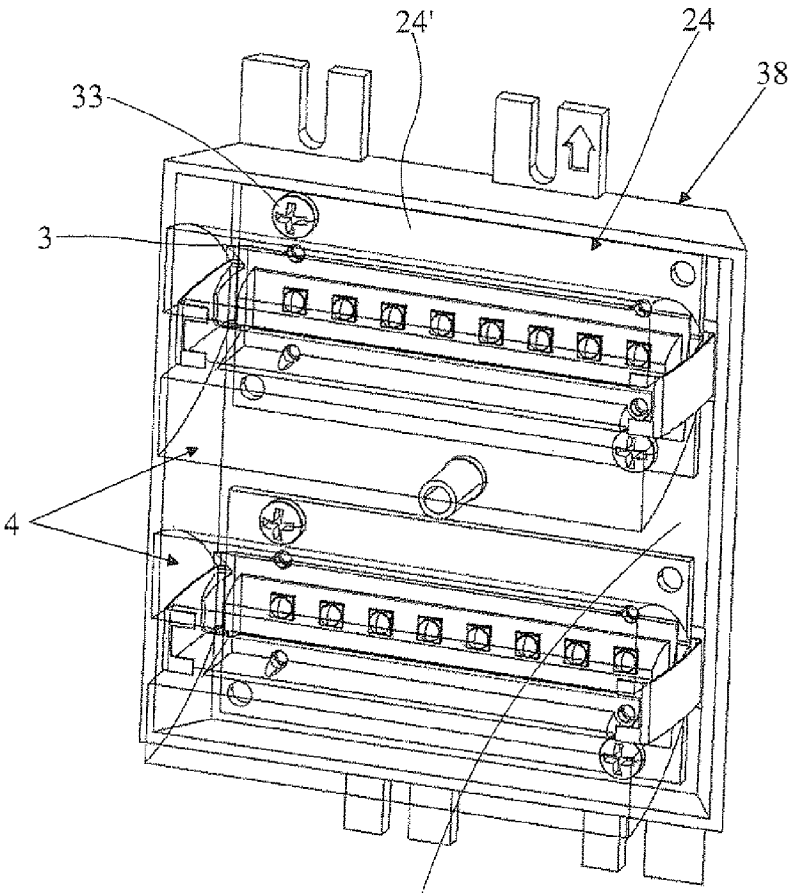
FIG. 8 shows a perspective view of a detail of the light indicator illustrated in FIG. 7, relative to a tray in which the LEDs and the lenses are mounted.
Figure 10:
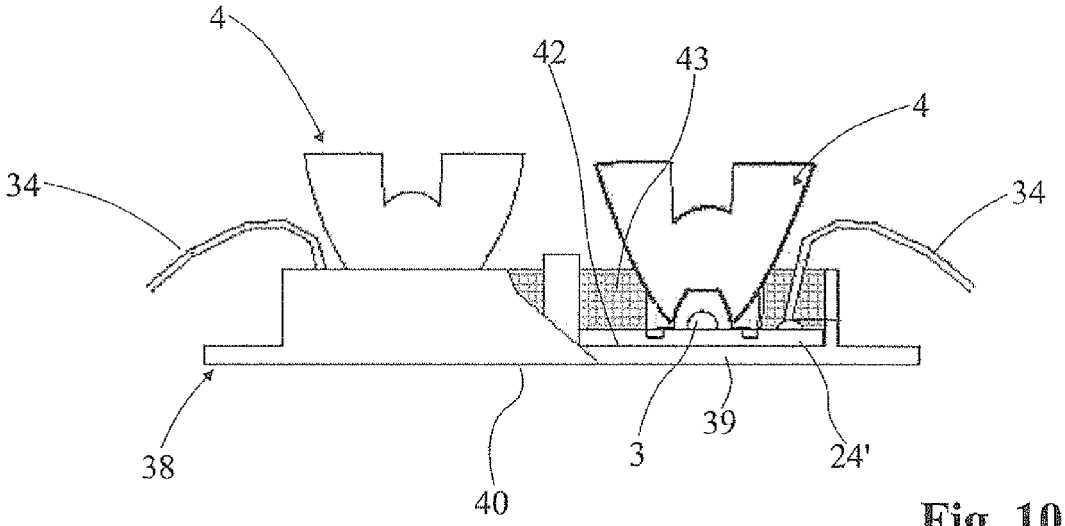
FIG. 10 shows a side view of the tray illustrated in FIG. 8, in which some parts have been removed in order to better illustrate the components of the indicator arranged inside the tray itself.

More in detail, with reference to the embodiment illustrated in FIGS. 8-10, each tray 38 comprises a bottom wall 39 provided with an external face 40 fixed to the corresponding flat face 12 of the external surface 5 of the support body 2, preferably by means of second fixing screws 41, and with an internal face 42 on which the rear face 25 of the support plates 24 arranged in such tray 38 is fixed.

In addition, the light indicator 1 comprises at least one insulating material layer 43 deposited inside each tray 38 to cover the circuit boards 24' on which the LEDs 3 are mounted, in order to insulate the electrical and electronic components of such circuit boards 24' from the inflammable gases of the external atmosphere, in a manner such that such components do not generate sparks that can trigger the inflammable gases present in the atmosphere of the area where the light indicator 1 is installed.

Figure 11:
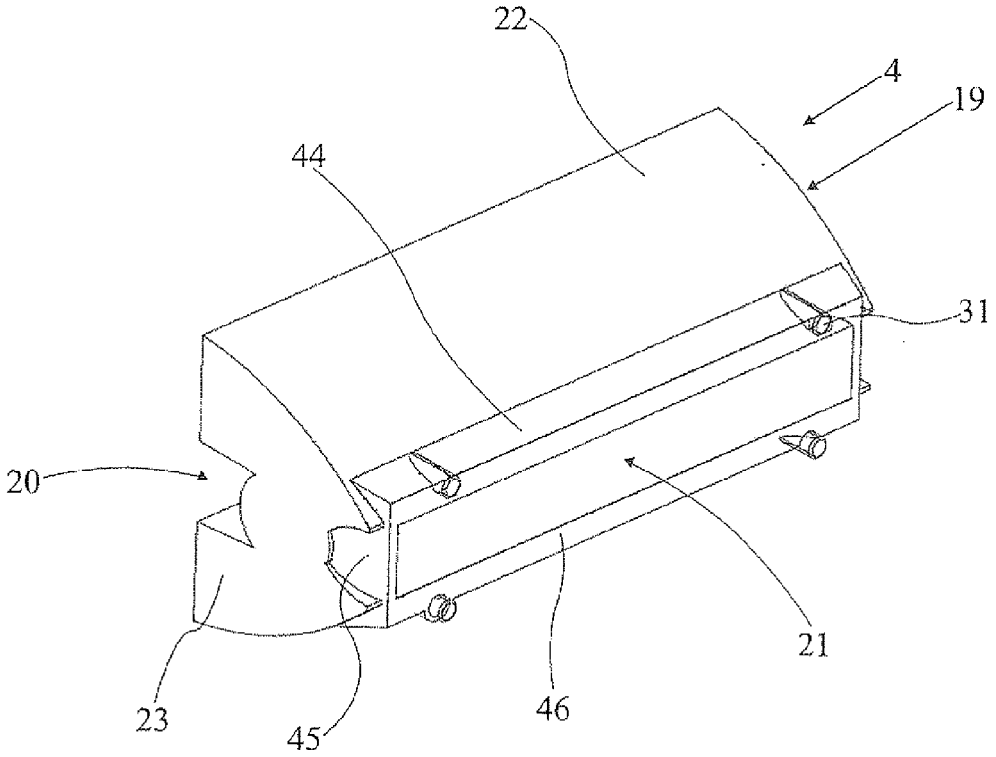
FIG. 11 shows a detail of the indicator illustrated in FIG. 7 relative to a collimation lens for the light emitted by the LEDs.

Advantageously, with reference to the embodiment illustrated in FIG. 11, the rear groove 21 of each lens 4, in which the corresponding row of LEDs 3 is housed, is closed by longitudinal walls and transverse walls 44 and 45 in order to prevent the insulating material 43, preferably constituted by silicone gel, from penetrating into the rear groove 21 and being deposited above the LEDs 3.

In particular, each lens 4 is provided on its rear part with two longitudinal walls 44 that are parallel to each other, which are extended parallel to the extension direction Z and transversely delimit between them the corresponding rear groove 21, and two transverse walls 45 placed to longitudinally close the rear groove 21 itself and preferably arranged orthogonal to the longitudinal walls 44.

The aforesaid longitudinal walls 44 and transverse walls 45 of each lens 4 define a rear edge 46, which delimits an opening of the corresponding rear groove 21 and adheres on the front face 26 of the electric circuit board 24', closing the aforesaid opening of the rear groove 21, in order to prevent the insulating material 43 from penetrating into the rear groove 21 itself.

Advantageously, in accordance with the aforesaid third embodiment of the present finding, on the internal face 42 of the bottom wall 39 of each tray 38, one or more aforesaid engagement cavities 36 are obtained and arranged at the peripheral edge 35 of each electric circuit board 24' in order to house the second bent portions 27 of the coupling bodies 15.

The engagement cavities 36 are preferably obtained with notches that are made, preferably during the molding of the tray 38, on the internal face 42 of the bottom wall 39 of the tray 38 itself.

Advantageously, each of such engagement cavities 36 is extended partially outside the peripheral edge 35 of the electric circuit board 24' of the support plate 24 in order to allow the insertion of the second bent portion 27 of the corresponding coupling body 15 in the cavity 36 itself.

Such engagement cavities 36 obtained on the tray 38 advantageously allow engaging the bent portions 27 of the coupling bodies 15 with the rear face 25 of the electric circuit board 24', at the same time allowing the adhesion of such rear face 25 to the internal face 42 of the bottom wall 39 of the corresponding tray 38 (preferably made of metal material, preferably aluminum), in a manner such to facilitate the thermal transmission of the heat (produced by the LEDs 3) between the electric circuit board 24' and the tray 38 with a consequent efficient heat removal.

In operation, in accordance with the third embodiment of the present finding, in order to mount the LEDs 3 and the lenses 4 on the light indicator 1, the operator preferably fixes each electric circuit board 24' (with the corresponding LEDs 3 mounted thereon) to the internal face 42 of the bottom wall 39 of the corresponding tray 38 by means of the first fixing screws 33, and subsequently inserts the second bent portions 27 of the coupling bodies 15 in the corresponding engagement cavities 36.

Afterward, the operator bends the central portion 47 of each coupling body 15 towards its external side 30 and arranges the lens 4 on the electric circuit board 24' in front of the corresponding row of LEDs 3. Then, the operator releases the central portion 28 of the coupling bodies 15 which, by elastic return, bears the corresponding first end bent 18 in abutment against the front surface 14 of the lens 4, at the same time inserting such first bent portion 18 within the front groove 20 of the lens 4 itself, in order to retain it integral with the electric circuit board 24'.

In accordance with a further, different embodiment of the present finding (not shown in the enclosed figures), the second end of each coupling body is fixed to the support body of the light indicator by means of at least one corresponding engagement screw screwed into a corresponding threaded hole obtained on the external surface of the support body itself.

The finding thus conceived therefore achieves the aforesaid objects.

In particular, the coupling bodies according to the present finding allow firmly fixing the lenses to the support body without using any adhesive substance which could deteriorate the LEDs.

The invention claimed is:

1. Light indicator, which comprises:

at least one support body;

at least one LED fixed to said support body;

at least one lens fixed to said support body, positioned in front of said LED, and provided with a rear surface directed towards said LED and with a front surface directed in the sense opposite that of said rear surface;

wherein said light indicator also comprises at least one coupling body, which is extended between two ends thereof, of which a rear end is engaged with said support body, and a front end is provided with at least one first bent portion engaged in abutment against the front surface of said lens; wherein said light indicator comprises at least one row of said LEDs arranged aligned with each other according to an alignment direction;

said lens having elongated form and extended between two ends thereof according to an extension direction substantially parallel to said alignment direction;

said light indicator comprising at least two of said coupling bodies each arranged at the respective end of said lens;

wherein said lens is provided, on the front surface, with a front groove inside of which the first bent portion of said coupling body is engaged, wherein the front groove of said lens is longitudinally extended according to said extension direction between said two ends of said lens, and at such ends said front groove terminates with two respective lateral openings in order to allow the insertion of the first bent portions of the corresponding said coupling bodies in said front groove.

2. Light indicator, which comprises:

at least one support body;

at least one LED fixed to said support body;

at least one lens fixed to said support body, positioned in front of said LED, and provided with a rear surface directed towards said LED and with a front surface directed in the sense opposite that of said rear surface;

wherein said light indicator also comprises at least one coupling body, which is extended between two ends thereof, of which a rear end is engaged with said support body, and a front end is provided with at least one first bent portion engaged in abutment against the front surface of said lens; wherein said light indicator comprises at least one support plate provided with a rear face fixed to said support body, and with a front face, directed in the sense opposite said rear face, and on such front face said LED and said lens are fixed; the rear end of said coupling body being provided with at least one second bent portion which is engaged in abutment against the rear face of said support plate.

3. Light indicator according to claim 2, wherein said support plate comprises an electric circuit board adapted to power supply said LEDs.

4. Light indicator according to claim 2, wherein said coupling body is provided with a central portion which is placed to connect between said first and said second bent portion, and is provided with an internal side directed towards said lens, from which said bent portions are projectingly extended.

5. Light indicator according to claim 4, wherein each bent portion of said coupling body delimits, with the internal side of said central portion, an angle less than or equal to 90°.

6. Light indicator according to claim 2, wherein each said coupling body is obtained with a metal plate bent at said ends.

7. Light indicator according to claim 2, wherein each said bent portion comprises at least two corresponding appendages that are parallel and spaced from each other.

8. Light indicator according to claim 2, wherein said support body is provided with at least one engagement cavity) arranged at the peripheral edge of said support plate and at least partially extended below the rear face of said support plate;

at said engagement cavity, the second bent portion of said coupling body is positioned, such second bent portion abuts against the portion of the rear face of said support plate facing said engagement cavity.

9. Light indicator according to claim 8, wherein said support body is provided with an external surface on which said support plate is fixed and on which said engagement cavity is obtained.

10. Light indicator according to claim 9, wherein said support body has substantially tubular form and is provided with an upper edge and with a lower edge between which said external surface is extended, on which multiple said support plates are fixed; said support body being provided with multiple said engagement cavities obtained with longitudinal grooves made on said external surface and extended between the upper edge and the lower edge of said support body.

11. Light indicator according to claim 8, wherein said support body has substantially tubular form with substantially polygonal section, and is provided with an upper edge and with a lower edge between which said external surface is extended, which is provided with multiple flat faces, on each of which at least one of said support plates is fixed;

each said flat face being connected to the flat face adjacent thereto by means of a rounded longitudinal edge of said external surface, and such rounded longitudinal edge delimits with the rear face of said support plates said engagement cavities.

12. Light indicator according to claim 8, wherein said support body comprises at least one tray, inside of which at least one said support plate is positioned; said tray comprising a bottom wall provided with an internal face on which the rear face of said support plate is fixed and on which said at least one engagement cavity is obtained.

13. Light indicator according to claim 1, wherein said coupling body is made of elastically flexible material.

14. Light indicator according to claim 2, wherein said lens is provided, on the front surface, with a front groove inside of which the first bent portion of said coupling body is engaged.

15. Light indicator according to claim 2, wherein said light indicator comprises at least one row of said LEDs arranged aligned with each other according to an alignment direction; said lens having elongated form and extended between two ends thereof according to an extension direction substantially parallel to said alignment direction; said light indicator comprising at least two of said coupling bodies each arranged at the respective end of said lens.

16. Light indicator according to claim 15, wherein said lens is provided, on the front surface, with a front groove inside of which the first bent portion of said coupling body is engaged, wherein the front groove of said lens is longitudinally extended according to said extension direction between said two ends of said lens, and at such ends said front groove terminates with two respective lateral openings in order to allow the insertion of the first bent portions of the corresponding said coupling bodies in said front groove.

* * * * *